US009605366B2

(12) United States Patent
Koike et al.

(10) Patent No.: US 9,605,366 B2
(45) Date of Patent: Mar. 28, 2017

(54) SEWING MACHINE

(71) Applicant: JANOME SEWING MACHINE CO., LTD., Tokyo (JP)

(72) Inventors: Mikio Koike, Oume (JP); Jun Mafune, Kokubunji (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 170 days.

(21) Appl. No.: 14/556,836

(22) Filed: Dec. 1, 2014

(65) Prior Publication Data

US 2015/0354116 A1 Dec. 10, 2015

(30) Foreign Application Priority Data

Jun. 6, 2014 (JP) ..... 2014-117453

(51) Int. Cl.

| | |
|---|---|
| ***D05B 57/32*** | (2006.01) |
| ***D05B 57/34*** | (2006.01) |
| ***D05B 57/36*** | (2006.01) |
| ***D05B 69/12*** | (2006.01) |
| ***D05B 3/02*** | (2006.01) |

(52) U.S. Cl.

CPC ..... *D05B 57/32* (2013.01); *D05B 3/02* (2013.01); *D05B 57/34* (2013.01); *D05B 57/36* (2013.01); *D05B 69/12* (2013.01)

(58) Field of Classification Search

CPC ..... D05B 69/12; D05B 55/14; D05B 73/00

USPC ..... 112/220, 221, 259, 217.3

See application file for complete search history.

(56) References Cited

U.S. PATENT DOCUMENTS

| | | | | |
|---|---|---|---|---|
| 2,480,734 A * | 8/1949 | Hohmann | ..... | D05B 59/00 112/221 |
| 4,503,793 A * | 3/1985 | Odermann | ..... | D05B 59/00 112/221 |
| 5,555,829 A * | 9/1996 | Katou | ..... | D05B 69/12 112/220 |

FOREIGN PATENT DOCUMENTS

| | | | |
|---|---|---|---|
| CN | 101100793 | A | 1/2008 |
| CN | 101270537 | A | 9/2008 |
| CN | 101545182 | A | 9/2009 |
| CN | 103031676 | A | 4/2013 |
| CN | 202867735 | U | 4/2013 |
| CN | 203144694 | U | 8/2013 |
| DE | 102007031072 | A1 | 2/2008 |
| EP | 1972710 | A1 | 9/2008 |

(Continued)

OTHER PUBLICATIONS

European Patent Application No. 14195908.0, Search Report dated Sep. 4, 2015, seven (7) pages.

(Continued)

*Primary Examiner* — Tejash Patel
(74) *Attorney, Agent, or Firm* — Nath, Goldberg & Meyer; Jerald L. Meyer; Christopher Thomas

(57) ABSTRACT

A sewing machine includes an upper shaft rotatable so as to drive a needle bar, a lower shaft rotatable so as to drive a hook, an upper-shaft pulley attached to the upper shaft, a lower-shaft pulley attached to the lower shaft, a belt linking the upper-shaft pulley and the lower-shaft pulley, and synchronizing a rotation of the upper-shaft pulley and a rotation of the lower-shaft pulley with each other, a belt adjusting mechanism contacting the belt and changing a belt length at a tensioned side at which the belt is drawn, and a tensioner tensioning the belt in accordance with the change in the belt length of the belt at the tensioned side.

4 Claims, 6 Drawing Sheets

(56) References Cited

FOREIGN PATENT DOCUMENTS

| | | | |
|---|---|---|---|
| JP | S5643985 | A | 4/1981 |
| JP | S5967991 | A | 4/1984 |
| JP | 2008132234 | A | 6/2008 |
| JP | 2008264500 | A | 11/2008 |

OTHER PUBLICATIONS

Office action from Nov. 23, 2016 for corresponding application No. 103137309 with English translation.

* cited by examiner

SEWING MACHINE

CROSS-REFERENCE TO RELATED APPLICATIONS

This application is based upon and claims the benefit of priority from Japan Patent Application No. 2014-117453, filed on Jun. 6, 2014, the entire contents of which are incorporated herein by reference.

FIELD OF THE INVENTION

The present invention relates to a sewing machine including a mechanism that adjusts a timing at which a needle and hook intersect regardless of the position of the needle which moves to wobble from side to side.

BACKGROUND

In sewing machines, an upper thread is inserted in a needle, while a lower thread is retained in a hook. An upper shaft driving a needle bar and a lower shaft driving the hook are coupled with each other through a toothed belt. That is, when the upper shaft is driven by the drive force, etc., of a motor, the lower shaft also rotates, and the needle and the hook are relatively operated. Sewing machines catch, through the tip of the hook, the thread loop formed by the upper thread when the needle rises after falling to the needle bottom dead center, and form a stitch by intertwining the upper thread and the lower thread with each other.

A wobbling mechanism which is provided on the upper shaft swings the needle bar so as to intersect a cloth feeding direction, and thus sewing machines are capable of forming zig-zag stitches. When this wobbling mechanism is controlled and the swinging level of the needle bar and the timing thereof are adjusted, various complex sewing, such as a whipstitch, a pattern stitch, and a letter stitch, is realized.

When a complex sewing is performed, if the swing of the needle bar becomes large, the position of the needle frequently changes. Hence, the relative positional relationship between the needle and the hook changes, and the timing at which the needle and the hook relatively operate are changed together with the change in the relative positional relationship. When this timing change exceeds an allowable range, it becomes difficult to form a stitch.

Hence, according to conventional sewing machines, the swing level of the needle bar is limited so as to set the change in relative operation of the needle and the hook within a range that enables a formation of a stitch. Alternatively, two idlers forming an idler unit are caused to contact the toothed belt which couples the upper shaft and the lower shaft (see, for example, JP2008-264500 A). When the idler unit is driven so as to operate together with the swing of the needle bar in the case of, for example, zig-zag stitches, to change the belt length of the toothed belt at the tensioned side, thereby controlling the timing of the relative operation of the needle and the hook. Through such a control, the gap in the timing of the needle linked with the swing of the needle bar, and the hook is corrected, so as to enable a formation of a stitch even if the swing width is large.

In general, toothed belts are formed so as to have a certain slack due to the workability at the time of attachment and the safety reason. The idlers absorb such a slack at the loosen side of the toothed belt to suppress a detachment of the belt, thereby transmitting force stably. Conversely, JP2008-264500 A includes an idler unit having two idlers movable on a rotation plane of the toothed belt. This idler unit arbitrarily moves the slack between the tensioned side and the loosen side of the toothed belt, thereby controlling the timing of the needle and the hook.

However, the movement of the idlers partially detracts a function of absorbing the slack and making the tension of the toothed belt stable. When the idlers move, the absorbing level of the slack of the toothed belt by the idlers changes. Hence, the tension of the toothed belt is changed, causing vibrations and noises when power is transmitted, and a detachment of the belt.

According to conventional technologies, in order to address such problems, cam faces that drive respective two idlers are provided for a drive source which drives the idler units. The two idlers are operated differently so as to appropriately change the distance between the idlers, thereby maintaining a constant absorbing level of the slack of the toothed belt when the idlers move. The change in the tension of the belt is addressed by moving the idler unit as explained above.

However, the change in the tension of the toothed belt upon movement of the idler unit is affected by, for example, a variability of the component dimension, and a variability of the positional relationship between the upper shaft and the lower shaft, and between those and the idler unit. Hence, the way of moving the idler unit while changing the distance between the idlers and the change level of such a distance vary depending on a sewing machine. Thus, a fine adjustment mechanism to adjust the distance between the idlers is provided, but because of the nature of the adjustment of a fine change in tension when the toothed belt is rotated, the work is difficult and it is not practical in view of a mass-production.

The present invention has been made to address the above-explained problems of the conventional technologies, and it is an objective of the present invention to provide a sewing machine provided with a mechanism which can stably control a gap in the timing of a needle and a hook caused by a swing of a needle bar without a complex adjustment work.

SUMMARY OF THE INVENTION

A sewing machine to address the aforementioned problem includes: an upper shaft rotatable so as to drive a needle bar; a lower shaft rotatable so as to drive a hook; an upper-shaft pulley attached to the upper shaft; a lower-shaft pulley attached to the lower shaft; a belt linking the upper-shaft pulley and the lower-shaft pulley, and synchronizing a rotation of the upper-shaft pulley and a rotation of the lower-shaft pulley with each other; a belt adjusting mechanism contacting the belt and changing a belt length at a tensioned side at which the belt is drawn; and a tensioner tensioning the belt in accordance with the belt length of the belt.

The belt adjusting mechanism may include at least one idler contacting the tensioned side, and may change the belt length of the belt at the tensioned side by causing the idler to swing.

The tensioner may be provided at a loosen side where the belt is drawn out. The tensioner may be an elastic member.

The sewing machine may further include a restrictor restricting a movable range of the tensioner when a tensioned condition of the belt exceeds pushing force by the tensioner. The restrictor may include a stopper arm and a stopper disposed with a predetermined distance from the stopper arm, and the stopper arm may contact with the stopper to restrict the movable range of the tensioner when the tensioned condition of the belt exceeds the pushing force by the tensioner.

According to the present disclosure, it becomes possible to provide a sewing machine including a mechanism that can stably control a gap in the timing of a needle and a hook caused by a swing of a needle bar without a complex adjustment work.

DETAILED DESCRIPTION OF THE PREFERRED EMBODIMENTS

1. First Embodiment

1.1 Structure

Figure 1:
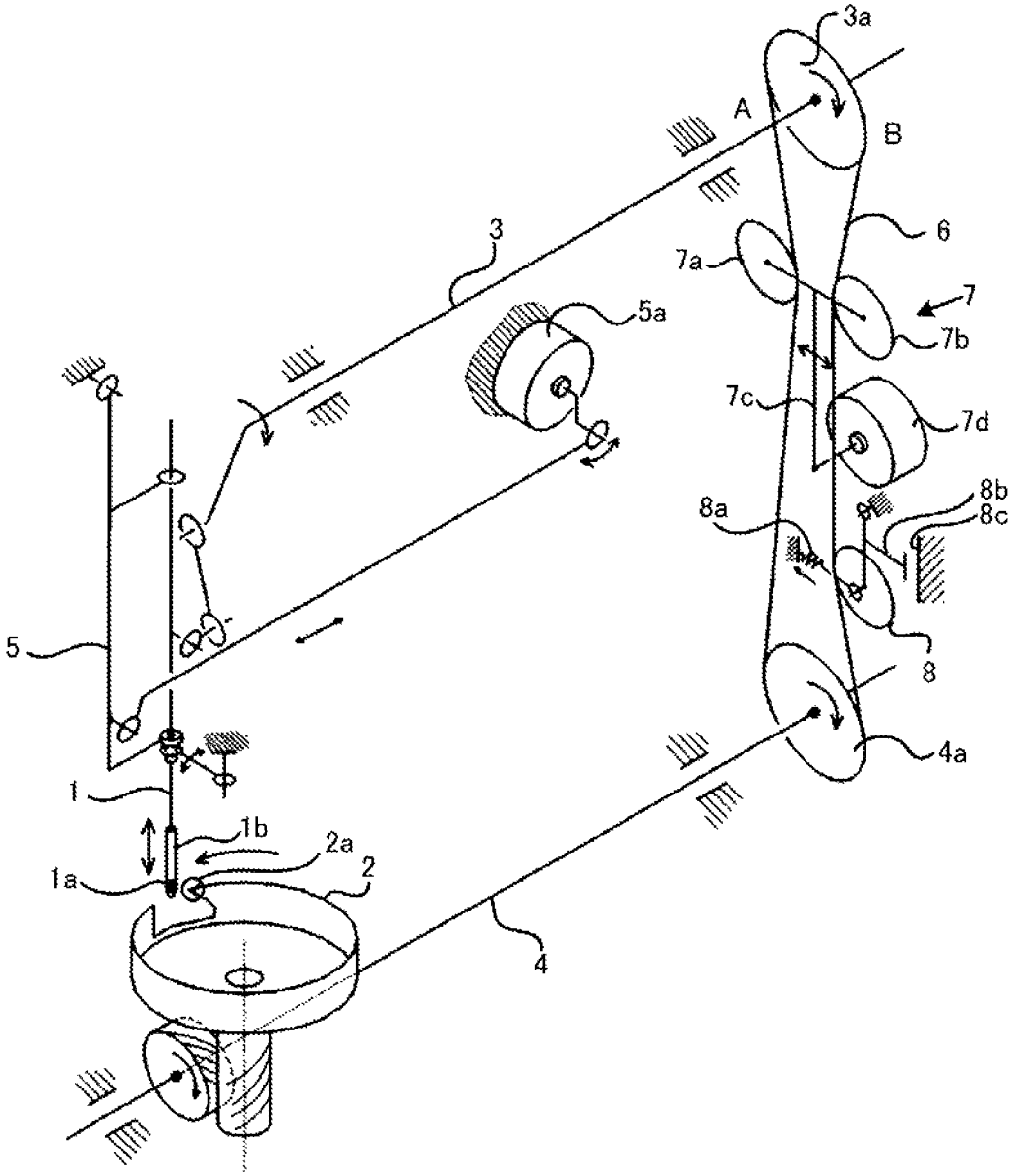
FIG. 1 is an explanatory diagram illustrating an example general structure of a sewing machine according to a first embodiment.

An embodiment of the present disclosure will be explained with reference to the accompanying drawings. In the following explanation, a structure that adjusts a timing at which a needle and a hook in a sewing machine intersect will be mainly explained. The explanation for a detailed structure of a sewing machine will be omitted, but the embodiment of the present disclosure is applicable to all sewing machines available currently or in future like a zig-zag stitching sewing machine. FIG. 1 illustrates an example general structure of a sewing machine of this embodiment.

(1) General Structure

The sewing machine includes a needle bar 1 and a hook 2. The needle bar 1 supports a needle 1*b* having a needle hole 1*a* where an upper thread is inserted. The hook 2 retains a bobbin around which a lower thread is wound. The needle bar 1 is linked with an upper shaft 3 through a crank mechanism. The hook 2 is linked with a lower shaft 4 through a gear mechanism. The upper shaft 3 and the lower shaft 4 are supported by respective unillustrated bearing fixed in the sewing machine so as to be freely rotatable. Drive force from an unillustrated sewing machine motor is transmitted to the upper shaft 3.

The crank mechanism of the upper shaft 3 converts the rotation of the upper shaft 3 into a reciprocal motion, and moves the needle bar 1 upwardly and downwardly. The upper shaft 3 is provided with a wobbling mechanism 5 that swings the needle bar 1. The wobbling mechanism 5 swings the needle bar 1 so as to intersect a cloth feeding direction by drive force from a wobbling motor 5*a*, thus zig-zag stitches are formed.

The upper shaft 3 is provided with an upper-shaft pulley 3*a* with a predetermined number of teeth. In addition, the lower shaft 4 is provided with a lower-shaft pulley 4*a* with the same number of teeth as that of the upper-shaft pulley 3*a*. The upper-shaft pulley 3*a* and the lower-shaft pulley 4*a* are linked together through a toothed belt 6. The length of the toothed belt 6 is set to be a length that has a predetermined slack when the toothed belt 7 is hung between the upper-shaft pulley 3*a* and the lower-shaft pulley 4*a*.

When the upper shaft 3 rotates, the upper-shaft pulley 3*a* also rotates, this rotation is transmitted to the lower-shaft pulley 4*a* through the toothed belt 6, and thus the lower shaft 4 rotates at the same speed as that of the upper shaft 3. The gear mechanism of the lower shaft 4 rotates the hook 2 together with the rotation of the lower shaft 4.

(2) Belt Adjusting Mechanism

A belt adjusting mechanism contacts the toothed belt 6 to adjust the belt length of the toothed belt 6 at the tensioned side, and has a function of correcting a timing at which the needle 1*b* and the hook 2 meet when the needle bar 1 is swung. In this embodiment, an explanation will be given of an idler unit 7 as an example. The idler unit 7 includes idlers 7*a*, 7*b* contacting the toothed belt 6 at a tensioned side A and a loosen side B, respectively. It is appropriate if the idler unit 7 has at least one idler at the tensioned side A.

In this case, the tensioned side A of the toothed belt 6 means a side where the upper-shaft pulley 3*a* is newly meshed upon rotation of the upper-shaft pulley 3*a*, i.e., a side where the belt is drawn. In addition, the loosen side B means a side where the meshing with the upper-shaft pulley 3*a* is loosened, i.e., a side where the belt is drawn out. In the following explanation, the tensioned side A and the loosen side B are referred to as right and left, respectively in some cases.

The idlers 7*a*, 7*b* are disposed at the tensioned side A and the loosen side B so as to hold the toothed belt 6 therebetween from the outer circumference of the toothed belt 6. The idlers 7*a*, 7*b* are coupled with a motor 7*d* through an arm 7*c*. The idlers 7*a*, 7*b* swing, by drive force from a motor 7*d*, in synchronization with the swing of the needle bar 1 by the wobbling mechanism 5. When the idler unit 7 is operated, the slack of the toothed belt 6 is moved to the tensioned side A and the loosen side B. Hence, the belt length of the toothed belt 6 at the tensioned side A is changed in accordance with the swinging condition of the needle bar 1. Accordingly, the timing of the upper shaft 3 and the lower shaft 4 is controlled, and thus a timing at which the needle 1*b* and a tip 2*a* of the hook 2 meet is adjusted.

(3) Tensioner

A tensioner absorbs a change in tension of the toothed belt 6 in accordance with a change in the belt length of the toothed belt 6 at the tensioned side A, thereby maintain a constant belt tension of the toothed belt 6. In a precise sense, it is ideal that, for example, the tensioner is movable in accordance with a change in the absorbing level of the slack of the toothed belt 6 by the idler unit 7, and a constant belt tension of the toothed belt 6 is maintained by using a tensioner that can apply a certain force like a plumb bob. In this embodiment, however, an explanation will be given of an example case in which an elastic member, such as a spring or a cushion, which can obtain the same effect as that of a plumb bob is applied.

A tension adjusting idler 8 is provided so as to contact the outer circumference of the toothed belt 6 at the loosen side B thereof. The tension adjusting idler 8 is provided with an elastic member 8*a*. The elastic member 8*a* causes the tension adjusting idler 8 to push the loosen side B of the toothed belt 6 from the outer circumference side of the toothed belt 6 to the inner circumference side thereof. An example elastic member 8*a* is a spring or a cushion.

The tension adjusting idler 8 changes the tensioning position when the elastic member 8*a* is deformed in accordance with a change in the absorbing level of the slack of the toothed belt 6 by the idler unit 7. Hence, a change in the absorbing level of the slack can be reduced. In addition, the toothed belt 6 is tensioned toward the inner circumference side by the elastic force of the elastic member 8*a*, and thus the belt tension can be maintained at constant.

Moreover, a restrictor which restricts the movable range of the elastic member 8*a* when the tensioned condition of the toothed belt 6 exceeds the pushing force by the elastic member 8*a* is provided. In this embodiment, as the restrictor, a stopper arm 8*b*, and a stopper 8*c* disposed so as to have a predetermined distance from the stopper arm 8*b* are provided. The stopper arm 8*b* is provided so as to be directed in the opposite direction to the tensioning direction of the elastic member 8*a*. The stopper 8*c* is disposed at a distance from the stopper arm 8 so as to contact with the stopper arm 8*b* when the tensioned condition of the toothed belt 6 exceeds the pushing force of the elastic member 8*a*.

1.2 Operation

An example operation of the aforementioned sewing machine will now be explained.

(1) Formation of Stitch

With the upper thread being inserted in the needle hole 1*a* of the needle 1*b* and the bobbin around which the lower thread is wound being retained in the hook 2, when the upper shaft 3 is driven, stitches are formed. More specifically, when the upper shaft 3 is driven by the sewing machine motor, the rotation of the upper shaft 3 is converted into a reciprocal motion by the crank mechanism, and the needle bar 1 is operated upwardly and downwardly. In addition, the rotation of the upper shaft 3 is transmitted to the lower shaft 4 through the upper-shaft pulley 3*a*, the toothed belt 6, and the lower-shaft pulley 4*a*. When the lower shaft 4 is rotated together with the rotation of the upper shaft 3, the hook 2 is rotated.

In such an operation, the needle 1*b* passes through a cloth, and moves to a needle lower dead center. When the needle 1*b* is raised to some level, the upper thread cannot be pulled out from the top face of the cloth due to a friction therewith, and thus a thread loop is formed on the bottom face of the cloth. When the tip 2*a* of the hook 2 passes through the thread loop, the bobbin around which the lower thread is wound passes through the thread loop, and the upper thread and the lower thread are intertwined with each other, and thus a stitch is formed.

(2) Formation of Thread Loop

Figure 2:
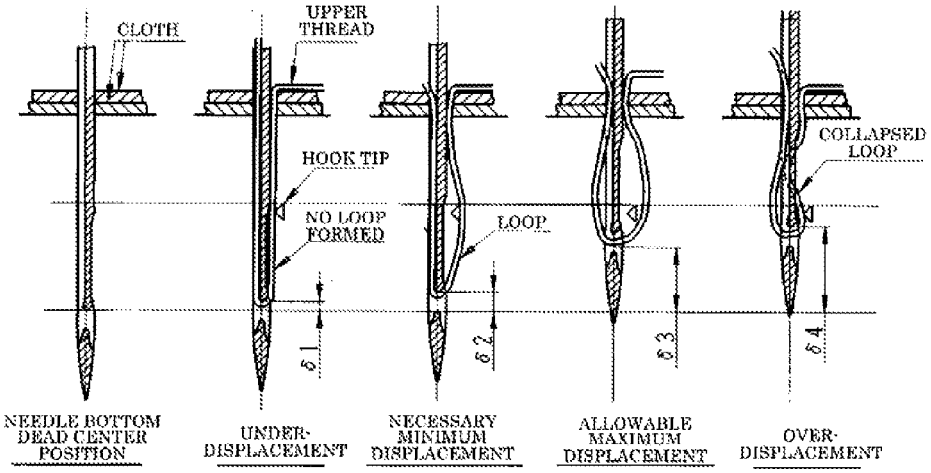
FIG. 2 is an explanatory diagram illustrating how a stitch is formed by a needle and a tip of a hook.

The size of the thread loop depends on the level of the needle 1*b* raised from the bottom dead center. In FIG. 2, the raised level of the needle 1*b* from the bottom dead center is indicated as a needle displacement δ. δ1 is an under-displacement of the needle 1*b*. When the displacement of the needle 1*b* is too small like δ1, it is difficult to form a thread loop. Even if the thread loop can be formed, the thread loop is too small, and the tip 2*a* cannot enter the thread loop. Conversely, δ4 indicates an over-displacement of the needle 1*b*. When the displacement of the needle 1*b* is too large like δ4, the thread loop becomes too large, and is collapsed due to the self-weight of the thread or twisting, and thus the tip 2*a* cannot enter the thread loop. As explained above, if the needle displacement is too small or too large, it is difficult to form a stitch.

Hence, in order to form an appropriate stitch, the needle displacement is required to be set so as to enables the formation of the thread loop and to allow the tip 2*a* of the hook 2 to enter the thread loop. In FIG. 2, a necessary minimum displacement is indicated as δ2, and an allowable maximum displacement is indicated as δ3. In order to form an appropriate stitch, it is necessary to set the needle displacement to be equal to or larger than δ2 but equal to or smaller than 63.

Figure 3:
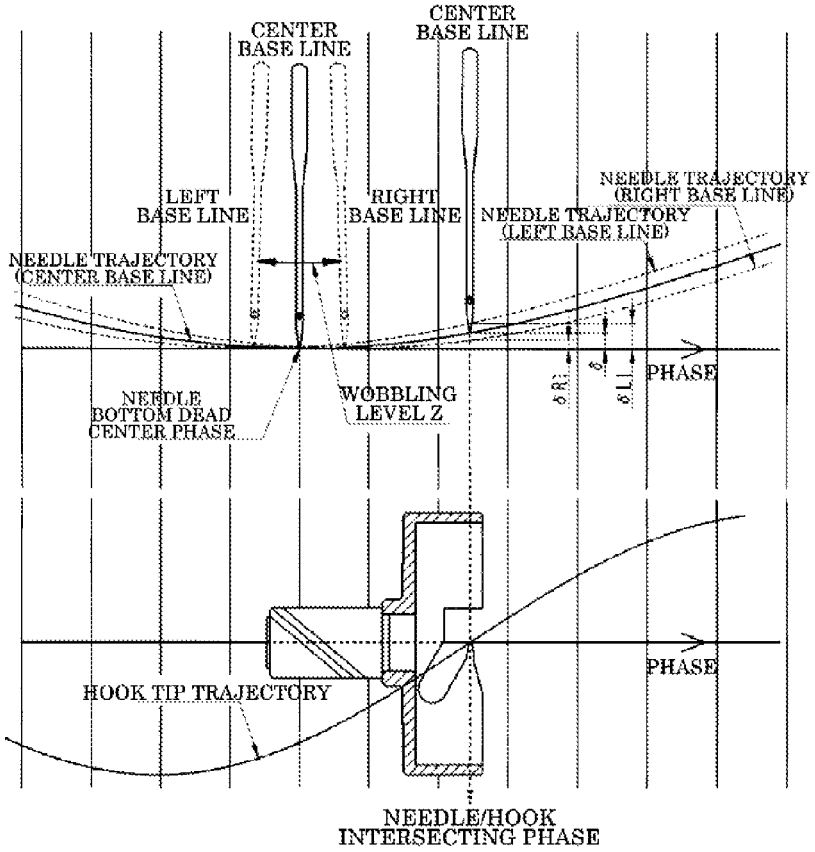
FIG. 3 is an explanatory diagram illustrating a change in the relative operation between the needle and the tip of the hook.

(3) Trajectory of Needle at the Time of Zig-Zag Sewing in Conventional Sewing Machines The wobbling mechanism 5 swings the needle bar 1 by the drive force from the wobbling motor 5*a* so as to intersect the cloth feeding direction, zig-zag stitches are formed. FIG. 3 illustrates, in conventional sewing machines, a change in the relative motion of the needle 1*b* and the tip 2*a* of the hook 2 when zig-zag sewing is performed. The horizontal axis in FIG. 3 represents the phases of the upper shaft 3 and the lower shaft 4, while the vertical axis represents the simulated trajectories of the tip of the needle 1*b* and the tip 2*a* of the hook 2. The trajectory of the tip 2*a* is slightly different from an actual trajectory, but is illustrated with a continuous line for the purpose of explanation. In the example in FIG. 3, it is presumed that the hook 2 rotates in a counterclockwise direction.

In FIG. 3, the needle 1*b* and the trajectory illustrated by thick lines indicate that the wobbling mechanism 5 is not actuated and the needle 1*b* is located at a center base line that is the center. In addition, the needle 1*b* and the trajectory illustrated by dashed lines indicate that the needle 1*b* swing to right and left by the wobbling mechanism 5. At the needle/hook intersecting phase in the figure, the needle 1*b* and the tip 2*a* are coming close to each other maximally. In such a needle/hook intersecting phase, the tip 2*a* enters the thread loop of the upper thread.

As explained above, in order to form a stitch, it is necessary to set the needle displacement to be equal to or larger than the necessary minimum displacement δ2 but equal to or smaller than allowable maximum displacement δ3. At the time of zig-zag sewing, however, the position of the hook 2 is constant but the needle 1*b* swings to right and left from the center base line, and thus the relative position of the needle 1*b* and the hook 2 changes. A change in the positional relationship affects the needle displacement.

When, for example, in conventional sewing machines, representing the needle displacement when the needle 1*b* is moved to the right as δR1, δR1 is smaller than the needle displacement δ in the center-base-line condition. In addition, representing the needle displacement when the needle 1*b* is moved to the left as δL1, δL1 becomes larger than the needle displacement δ in the center-base-line condition. That is, even if the needle displacement δ in the center-base-line condition is set to be an appropriate value, when the needle 1*b* swings right and left, δR1 becomes smaller than the minimum necessary displacement δ2 or δL1 becomes larger than the allowable maximum displacement δ3, and thus it sometime becomes difficult to form an appropriate thread loop.

A change in the needle displacement due to a position change of the needle 1*b* increases in proportional to a wobbling level Z of the needle 1*b* which swings right and left. Hence, according to conventional sewing machines, a stitch can be formed only when the needle displacement satisfies a condition $\delta 2<\delta R1<\delta<\delta L1<\delta 3$, the maximum wobbling level Z is automatically determined. Hence, even if there is a need for sewing of a pattern needing a larger wobbling than the voluntary set value, it is technically difficult to meet such a need.

(4) Trajectory of Needle when Belt Adjusting Mechanism is Applied

Figure 4:
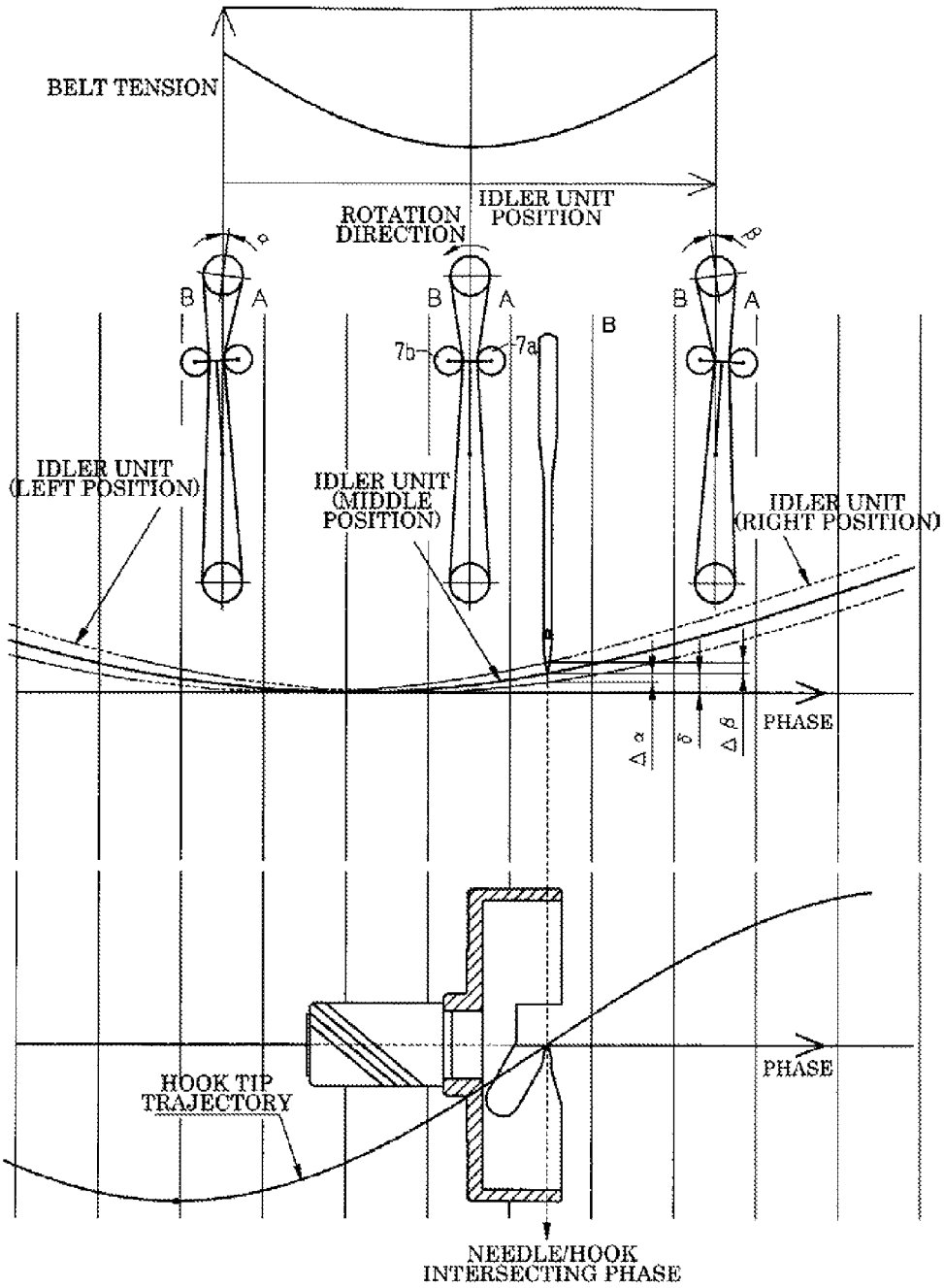
FIG. 4 is an explanatory diagram illustrating a change in the relative operation between the needle and the tip of the hook, and a change in the tension of a belt along with the change in the relative operation.

The belt adjusting mechanism corrects the needle displacement by changing the belt length of the toothed belt 6 at the tensioned side when the wobbling mechanism 5 swings the needle bar 1. FIG. 4 illustrates a change in the relative operation of the needle 1*b* and the tip 2*a* of the hook 2 when the idler unit 7 that is the belt adjusting mechanism is provided and zig-zag sewing is performed. The horizontal axis of FIG. 4 represents the phases of the upper shaft 3 and the lower shaft 4, while the vertical axis represents the simulated trajectories of the tip of the needle 1*b* and the tip 2*a* of the hook 2. The trajectory of the tip 2*a* is slightly different from an actual trajectory, but is indicated by a continuous line for the purpose of explanation. In the example case in FIG. 4, it is presumed that the hook 2 rotates counterclockwise.

In FIG. 4, the needle 1*b* and the trajectory illustrated by thick lines indicate that the idler unit 7 is located at a center position. In addition, the needle 1*b* and the trajectory illustrated by dashed lines indicate that the idler unit 7 is swung right and left. In the needle/hook intersecting phase in the figure, the needle 1*b* and the hook 2*a* are coming close to each other maximally. In this needle/hook intersecting phase, the tip 2*a* enters the thread loop of the upper thread.

When, for example, the idler unit 7 is moved to the left, i.e., when the idler unit 7 is moved in a direction in which the idler 7*a* pushes the tensioned side A of the toothed belt 6, the distance of the tensioned side A of the toothed belt 6 becomes long. When the distance at the tensioned side A becomes long, in comparison with a case in which the idler unit 7 is located at the center position, a phase difference a is produced between the upper shaft 3 an the lower shaft 4, and the needle displacement decreases by $\Delta\alpha$.

In addition, when the idler unit 7 is moved to the right, i.e., when the idler unit 7 is moved in a direction in which the idler 7*b* pushes the loosen side B of the toothed belt 6, the distance of the tensioned side A of the toothed belt 6 becomes short. When the distance at the tensioned side A becomes short, in comparison with a case in which the idler unit 7 is located at the center portion, a phase difference $\beta$ is produced between the upper shaft 3 and the lower shaft 4, and the needle displacement increases by $\Delta\beta$.

The increase/decrease in the needle displacement $\delta$ due to the movement of the idler unit 7 is determined by the position of the idler unit 7 regardless of the movement of the needle bar 1 by the wobbling mechanism 5. Hence, by swinging the idler unit 7, a decrease by $\Delta\alpha$ or an increase by $\Delta\beta$ can be given to the needle displacement $\delta$.

As explained above, in conventional sewing machines, it is necessary to set the maximum value of the wobbling level Z to satisfy, for the needle displacement changing in proportional to the wobbling level Z, a condition $\delta 2<\delta R1<\delta<\delta L1<\delta 3$. Conversely, according to the advantageous effects of the sewing machine of this embodiment, an increase/decrease in the needle displacement by the movement of the idler unit 7 can be determined by the position of the idler unit 7 regardless of the movement of the needle bar 1 by the wobbling mechanism 5. Hence, when a setting is made so as to cancel the increase/decrease in the needle displacement by the movement of the needle bar 1 by the increase/decrease in the needle displacement by the movement of the idler unit 7, a condition $\delta 2<(\delta R2+\Delta\beta)<\delta<(\delta L2-\Delta\alpha)<\delta 3$ is satisfied. In this case, $\delta R2$ is a needle displacement when the needle bar 1 wobbles to the right maximally in the sewing machine of this embodiment. Also, $\delta L2$ is a needle displacement when the needle bar 1 wobbles to the left maximally in the sewing machined of this embodiment.

When the needle displacement at the time of maximum right/left wobbling is compared between a conventional sewing machine and the sewing machine of this embodiment, $\delta R1=\delta R2+\Delta\beta$, and $\delta L1=\delta L2-\Delta\alpha$. $\delta R2$ can be reduced by $\Delta\beta$ relative to $\delta R1$, while $\delta L2$ can be increased by $\Delta\alpha$ relative to $\delta L1$. In this case, since the needle displacement change level and the maximum value of the wobbling level Z are proportional, i.e., according to the sewing machine of this embodiment, the maximum value of the wobbling level Z can be set larger than that of the conventional sewing machine.

Conversely, when the idler unit 7 is moved to the tensioned side A and the loosen side B, the slack of the belt absorbed by the idler unit 7 changes, and thus the tensioned condition of the toothed belt 6 changes as illustrated in the upper part of FIG. 4. That is, at a time point at which the idler unit 7 is moved to a predetermined right/left position, the tension of the toothed belt 6 becomes the maximum. When the idler unit 7 is moved in accordance with the swing of the needle bar 1 operating at a fast speed, the tensioned condition of the toothed belt 6 is suddenly changed. A sudden change in the tensioned condition of the toothed belt 6 may decrease the durability of the toothed belt 6, and may cause vibrations and noises. In addition, the toothed belt 6 may be loosened and detached, and the meshing with the teeth of the upper-shaft pulley 3*a* and the lower-shaft pulley 4*a* may be mis-positioned.

(4) Change in Tension when Tensioner is Applied

Figure 5:
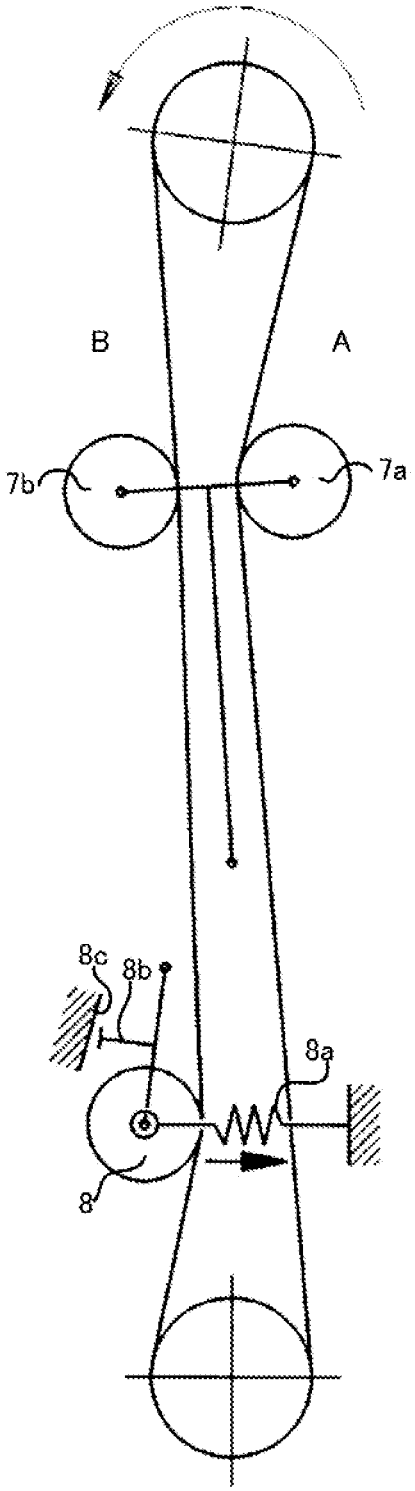
FIG. 5 is an explanatory diagram illustrating how the loosen side of the belt is tensioned by a tensioner.

The tension adjusting idler 8 is provided with the elastic member 8*a* that is the tensioner, and as illustrated in FIG. 5, when the idler 7*a* is moved in a direction pushing the tensioned side A of the toothed belt 6, the tension adjusting idler 8 is pushed in a direction pushing the loosen side B of the toothed belt 6. The position where the tension adjusting idler 8 pushes the toothed belt 6 changes in accordance with a change in the absorbing level of the slack of the toothed belt 6 by the idler unit 7. That is, when the absorbing level of the slack by the idler unit 7 is large and the tensioned condition of the toothed belt 6 is high, the pushing position of the tension adjusting idler 8 moves to the external side of the toothed belt 6, i.e., moves in a direction in which the slack absorbed by the tension adjusting idler 8 becomes small. In addition, when the absorbing level of the slack by the idler unit 7 is small and the tensioned condition of the toothed belt 6 is not high, the pushing position of the tension adjusting idler 8 moves to the internal side of the toothed belt 6, i.e., moves in a direction in which the slack absorbed by the tension adjusting idler 8 becomes large.

Figure 6:
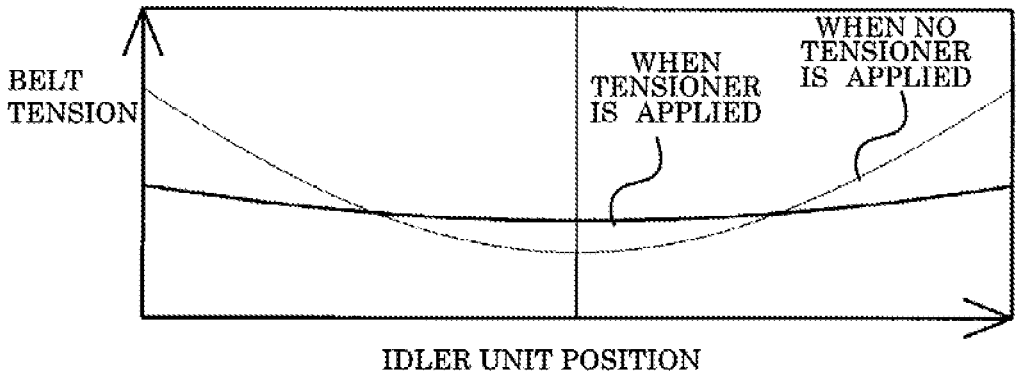
FIG. 6 is an explanatory diagram illustrating a change in the tension of the belt when the tensioner is applied.

FIG. 6 illustrates a tensioned condition of the toothed belt 6 when the tension adjusting idler 8 linked with the elastic member 8*a* is applied. When the tension adjusting idler 8 is applied, the absorbing level of the slack by the tension adjusting idler 8 changes so as to make the sum of the absorbing level of the slack of the toothed belt 6 by the idler unit 7 and the absorbing level of the slack by the tension adjusting idler 8 at constant. Hence, unlike the case in which a member equivalent to the tensioner is not provided, the tensioned condition is not suddenly changed, and thus a change level in the tensioned condition is remarkably eased.

(5) Operation of Restrictor

Figure 7:
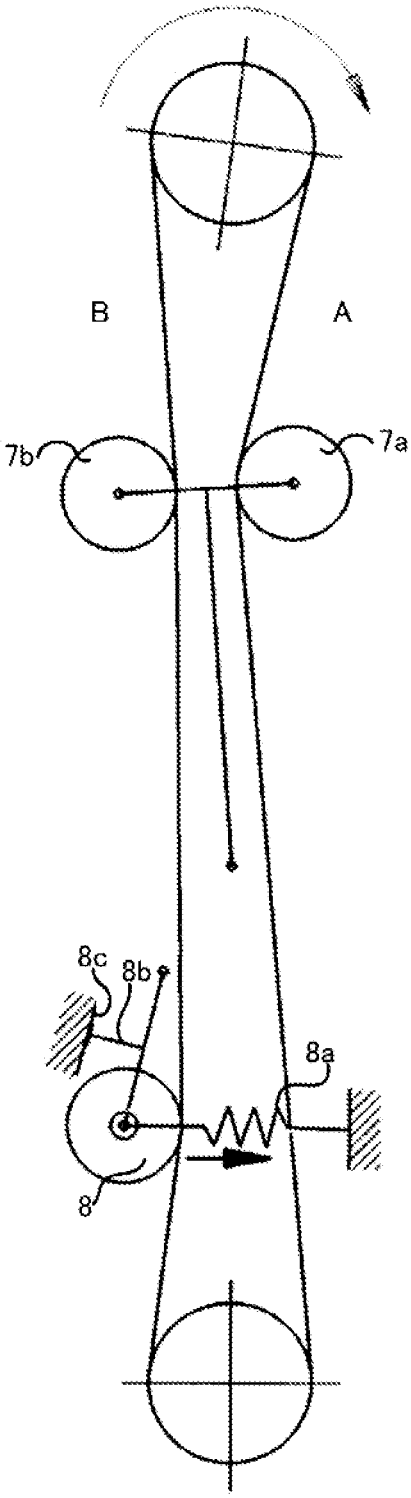
FIG. 7 is an explanatory diagram illustrating how a motion range of the tensioner is restricted by a restrictor.

Operations of the stopper arm 8*b* and the stopper 8*c* which are the restrictor will be explained with reference to FIG. 7.

In the operation condition of a normal sewing machine, the tensioned side A of the toothed belt 6 and the loosen side B thereof are not switched. When, however, a sewing machine is actually used by a user and for example, the lower thread is entangled and the hook 2 is locked, and, the upset user manually turns a flywheel in the reverse direction, unintentional load is caused. In this case, the tensioned side A of the toothed belt 6 and the loosen side B thereof may be temporarily switched.

When the tensioned side A of the toothed belt 6 and the loosen side B are switched by an occurrence of unintentional load, the tensioned condition of the toothed belt 6 increases beyond the pushing force of the elastic member 8*a*. In this case, as illustrated in FIG. 7, the stopper arm 8*b* collides with the stopper 8*c*, and the motion of the tension adjusting idler 8 is restricted to a certain position. When the movable range of the elastic member 8*a* is restricted as explained above, the toothed belt 6 is prevented from being loosened beyond the expected level. Hence, a tooth jumping of the toothed belt 6 is prevented, and thus the reference of the timing of the upper shaft 3 and the lower shaft 4 is maintained.

1.3 Advantageous Effects

The sewing machine of this embodiment employing the aforementioned structure has the following advantages.

(1) Since the idler unit 7 that is a belt adjusting mechanism is provided and the belt length of the toothed belt 6 is changed at the tensioned side A, the timing of the needle 1*b* and that of the hook 2 are controlled arbitrarily. A change in the belt tension caused at this time by a change in the absorbing level of the slack can be remarkably reduced by the belt adjusting idler 8 which is linked with the elastic member 8*a* that is the tensioner and which tensions the loosen side B of the toothed belt 6. Hence, a gap of the timing between the needle and the hook caused due to a swing of the needle bar can be stably controlled without a bothersome adjusting work. In addition, occurrences of vibrations and noises can be suppressed.

In addition, the toothed belt 6 is prevented from being loosened and detached due to a change in the tensioned condition, and thus the disengagement of the toothed belt 6 and the pulleys can be prevented. Hence, no tooth jump occurs. As explained above, the timing of the relative operation of the needle 1*b* and the hook 2 can be adjusted, making the operation of the sewing machine more stable.

(2) Because of variability of the axial center of the upper-shaft pulley 3*a* and that of the lower-shaft pulley 4*a*, and variability of the tensile strength of the toothed belt 6, the tension of the toothed belt 6 becomes varied while the sewing machine is operated. In this embodiment, such a variation that cannot be absorbed by conventional idlers can be absorbed by finely changing the pushing position through the elongation/compression of the elastic member 8*a*.

(3) According to conventional sewing machines, a work of adjusting the slack of the toothed belt 6 and fixing the position of the idlers, etc. is necessary, so as to obtain a predetermined tensioned condition of the toothed belt 6 when the toothed belt 6 is attached. According to this embodiment, however, the tensioned condition of the toothed belt 6 can be adjusted through the elastic member 8*a*, and thus the attaching work of the toothed belt 6 can be simplified.

(4) Since the stopper arm 8*b* and the stopper 8*c* are provided as the restrictor, when the tensioned condition of the toothed belt 6 increases and exceeds the pushing force by the tensioner, the movable range of the tensioner is restricted. When the motion of the tensioner is restricted by the restrictor, the toothed belt 6 is prevented from being elongated and loosened beyond necessity. Therefore, a tooth jump of the toothed belt 6 is prevented, thereby suppressing a misalignment of the reference of the timing of the upper shaft 3 and the lower shaft 4.

2. Other Embodiments

The present invention is not limited to the aforementioned embodiment, and permits various modifications as needed.

(1) In the aforementioned embodiment, the belt adjusting mechanism includes the idler unit 7 having the two idlers 7*a*, 7*b* contacting the tensioned side A of the toothed belt 6 and the loosen side B thereof, respectively. However, the structure employing the two idlers is for the safety reason, and at least one idler may be provided at the tensioned side A of the toothed belt 6. In addition, the idler 7*b* at the loosen side B of the idlers 7*a*, 7*b* may be provided with a tensioner to accomplish the function of the tension adjusting idler 8. According to this structure, the number of components can be reduced, and the same advantageous effects as those of the aforementioned embodiment can be also accomplished.

(2) The idler unit 7 basically swings in synchronization with the wobbling of the needle 1*b*, and controls the timing of the needle 1*b* and that of the hook 2. In the aforementioned embodiment, the motor 7*d* that drives the idler unit 7 is provided, but when a structure that transmits the drive force by the wobbling motor 5*a* to the idler unit 7 is employed, the motor 7*a* becomes unnecessary. According to this structure, the number of components can be reduced.

(3) In the aforementioned embodiment, as the tensioner, the elastic member 8*a* including a spring is employed and the stopper arm 8*b* and the stopper 8*c* are provided, but the function of the restrictor may be realized using a compression spring or a spring with a high spring constant. In addition, a finite-stroke spring with a stopper may be utilized. Still further, when the shaft of the tension adjusting idler 8 is inserted in an elongated hole, the predetermined movable range thereof may be restricted.

(4) The embodiment of the present invention was explained above, but the present invention permits various omissions, replacements, and modifications without departing from the scope and spirit of the present disclosure. Such embodiments and modifications thereof are also within the scope and spirit of the present disclosure as recited in the appended claims, and within the equivalent range thereto.

What is claimed is:

1. A sewing machine comprising:

an upper shaft rotatable so as to drive a needle bar;

a lower shaft rotatable so as to drive a hook;

an upper-shaft pulley attached to the upper shaft;

a lower-shaft pulley attached to the lower shaft;

a belt linking the upper-shaft pulley and the lower-shaft pulley, and synchronizing a rotation of the upper-shaft pulley and a rotation of the lower-shaft pulley with each other;

a belt adjusting mechanism contacting the belt and absorbing slack at a tensioned side at which the belt is drawn by moving in or away from a direction in which the belt adjusting mechanism pushes the tensioned side; and a tensioner tensioning the belt in accordance with an absorbing level of the slack of the belt;

wherein the tensioner comprises;

a tension adjusting idler contacting the belt at the loosened side where the belt is drawn out; and an elastic member connecting to the tension adjusting idler.

2. The sewing machine according to claim 1, wherein the belt adjusting mechanism:

comprises at least one idler contacting the tensioned side; and changes the absorbing level of the slack of the belt at the tensioned side by causing the idler to swing.

3. The sewing machine according to claim 1, further comprising a restrictor restricting a movable range of the tensioner when a tensioned condition of the belt exceeds pushing force by the tensioner.

4. The sewing machine according to claim 3, wherein:

the restrictor comprises a stopper arm and a stopper disposed with a predetermined distance from the stopper arm; and the stopper arm contacts with the stopper to restrict the movable range of the tensioner when the tensioned condition of the belt exceeds the pushing force by the tensioner.

* * * * *